US008123213B2

(12) United States Patent
Bridges et al.

(10) Patent No.: US 8,123,213 B2
(45) Date of Patent: Feb. 28, 2012

(54) SHEET SIZE DETECTION DEVICE

(75) Inventors: Richard Thomas Calhoun Bridges, London (GB); David Stewart, Hertforshire (GB)

(73) Assignee: Xerox Corporation, Norwalk, CT (US)

( * ) Notice: Subject to any disclaimer, the term of this patent is extended or adjusted under 35 U.S.C. 154(b) by 204 days.

(21) Appl. No.: 12/269,472

(22) Filed: Nov. 12, 2008

(65) Prior Publication Data

US 2010/0117291 A1 May 13, 2010

(51) Int. Cl.
*B65H 1/00* (2006.01)
*G03G 15/00* (2006.01)

(52) U.S. Cl. ..... 271/171; 399/389

(58) Field of Classification Search ..... 271/171; 399/389

See application file for complete search history.

(56) References Cited

U.S. PATENT DOCUMENTS 4,780,740 A * 10/1988 Fukae ..... 399/86
4,786,042 A * 11/1988 Stemmle ..... 271/9.1
5,190,280 A * 3/1993 Gray et al. ..... 271/171
5,343,142 A 8/1994 Sasaki et al.
6,254,085 B1 * 7/2001 Kang ..... 271/171
7,144,007 B2 * 12/2006 Kim ..... 271/171
7,413,188 B2 * 8/2008 Miki ..... 271/171
7,441,769 B2 * 10/2008 Miki ..... 271/171
7,540,677 B2 * 6/2009 Allwright ..... 400/624
7,694,960 B2 * 4/2010 Sing ..... 271/171

FOREIGN PATENT DOCUMENTS

JP 05186056 A * 7/1993

* cited by examiner

*Primary Examiner* — Michael McCullough
*Assistant Examiner* — Luis A Gonzalez
(74) *Attorney, Agent, or Firm* — Fay Sharpe LLP

(57) ABSTRACT

A sheet size detection device for detecting a size of sheets which are held in a sheet tray is disclosed. The device comprises first and second guide members, first and second brackets, and a plurality of switches. The first guide member is movable in accordance with a first dimension of the sheets. The second guide member is movable in accordance with a second dimension of the sheets. Each bracket is operatively connected to its respective guide member and includes a plurality of slots extending through a solid surface. The plurality of switches is configured for selective engagement by at least one of the brackets. The solid surface and the plurality of slots of each bracket are configured to interact with one another to selectively engage the plurality of switches. The selective engagement of the plurality of switches enables conveyance of two dimensions of the sheet size.

20 Claims, 6 Drawing Sheets

SHEET SIZE DETECTION DEVICE

BACKGROUND

1. Technical Field

The presently disclosed embodiments are directed to sheet size detection devices as could be used in a number of devices such as, for example, multi-functional devices.

2. Description of Related Art

Multi-functional devices (MFD) often include adjustable sheet trays which facilitates use of a range of media sizes. A single adjustable sheet tray can typically accommodate common American- and European-sized media. Additionally, the trays often have the ability to detect a size of the media that is held therein. In MFDs that have the ability to detect a size of the media, users may simply confirm the media size via the User Interface (UI) instead of using the UI to input the dimensions.

In these types of MFDs, when the user places custom size (i.e., non-standard size) media in the sheet tray, a signal is sent to the UI. The signal typically does not relay any information about the media, other than that the media was not detected as a standard size. The user may then confirm that the media is indeed custom and may then be prompted to use the UI to input the dimensions of the media. The UI is unable to determine whether the size inputted by the user is the correct size of the media held in the sheet tray.

SUMMARY

Embodiments of the present disclosure relate to a sheet size detection device for detecting a size of sheets which are held in a sheet tray. The sheet size detection device comprises a first guide member, a second guide member, a first bracket, a second bracket, and a plurality of switches. The first guide member defines a position of the sheets in a first direction of said sheets, the first guide member is movable in accordance with a first dimension of the sheets. The second guide member defines a position of the sheets in a second direction of the sheets, the second direction being orthogonal to the first direction. The second guide member is movable in accordance with a second dimension of the sheets. The first bracket is operatively connected to the first guide member and includes a plurality of slots extending through a solid surface. The second bracket is operatively connected to the second guide member and is moveable with respect to the first bracket. The second bracket includes a plurality of slots extending through a solid surface. The plurality of switches is configured for selective engagement by at least one of the first bracket and the second bracket. The solid surface and the plurality of slots of the first bracket, and the solid surface and the plurality of slots of the second bracket are configured to interact with one another to selectively engage the plurality of switches. The selective engagement of the plurality of switches enables conveyance of two dimensions of the sheet size.

Other embodiments of the present disclosure relate to a sheet tray positionable in a printing device. The sheet tray comprises a base, a length guide, a width guide, a first bracket, a second bracket, and a plurality of switches. The length guide is slidably disposed with relation to the base. The width guide is slidably disposed with relation to the base. The first bracket is disposed in mechanical cooperation with the length guide and includes a solid surface having a plurality of slots therethrough. The second bracket is disposed in mechanical cooperation with the width guide and includes a solid surface having a plurality of slots therethrough. The plurality of switches is disposed in mechanical cooperation with the first bracket and with the second bracket. The solid surface and the plurality of slots of the first bracket, and the solid surface and the plurality of slots of the second bracket are configured to interact with one another to selectively engage the plurality of switches. The selective engagement of the plurality of switches enables conveyance of two dimensions of the sheet size.

Other embodiments of the present disclosure relate to a multi-functional device comprising a sheet size detection device. The printing device comprises a sheet tray positionable in the printing device. The sheet tray comprises a base, a length guide, a width guide, a first bracket, a second bracket, and a plurality of switches. The length guide is slidably disposed with relation to the base. The width guide is slidably disposed with relation to the base. The first bracket is disposed in mechanical cooperation with the length guide and includes a solid surface having a plurality of slots therethrough. The second bracket is disposed in mechanical cooperation with the width guide and includes a solid surface having a plurality of slots therethrough. The plurality of switches is disposed in mechanical cooperation with the first bracket and with the second bracket. The solid surface and the plurality of slots of the first bracket, and the solid surface and the plurality of slots of the second bracket are configured to interact with one another to selectively engage the plurality of switches. The selective engagement of the plurality of switches enables conveyance of two dimensions of the sheet size.

DETAILED DESCRIPTION

Figure 1:
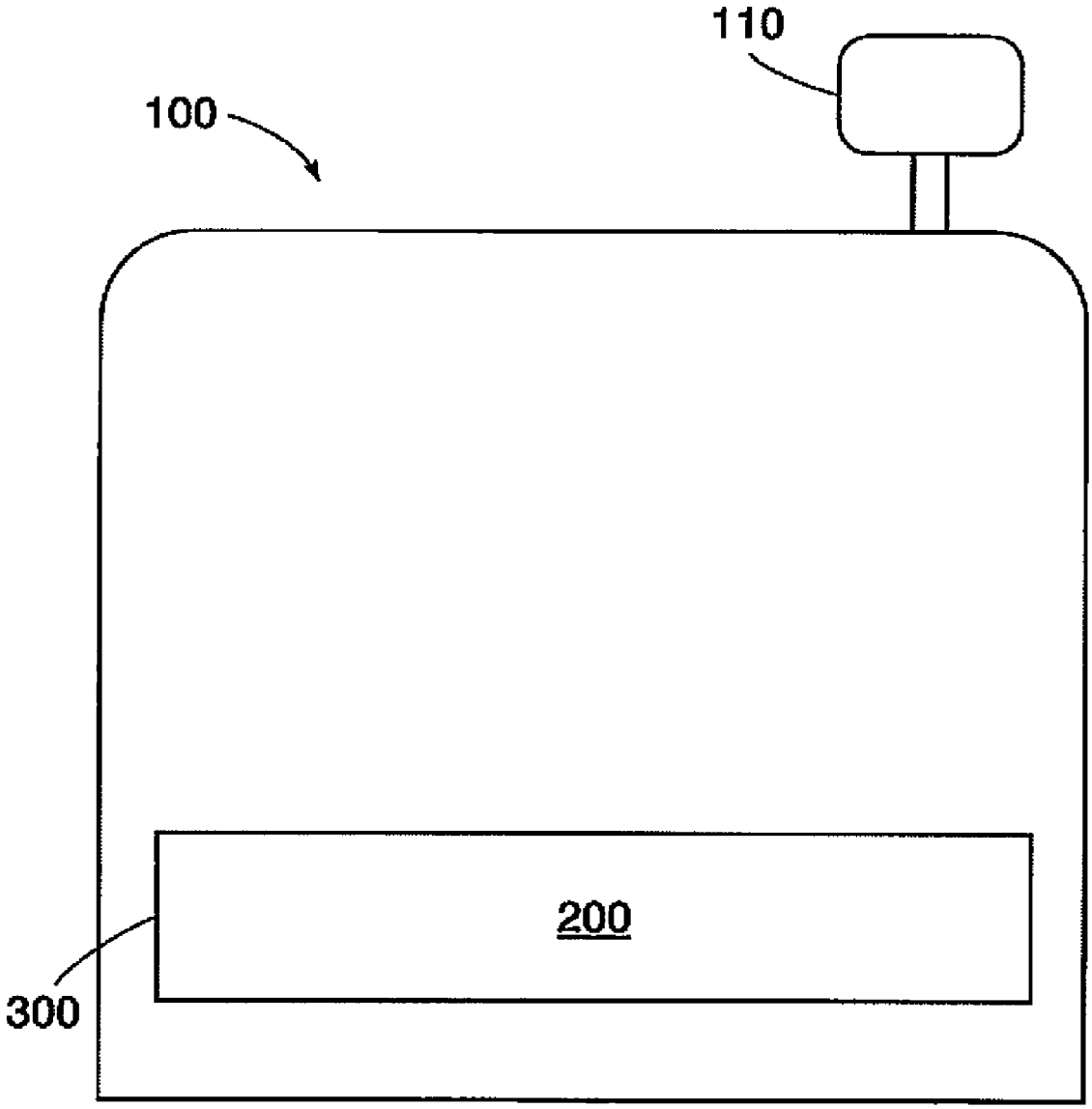
FIG. 1 is a schematic view of a Multi-Functional Device (MFD) in accordance with embodiments of the present disclosure.

A multi-functional device (MFD) 100 in accordance with various embodiments of the present disclosure is shown in FIG. 1. While MFD 100 is shown as a specific type of device in FIG. 1, it will be appreciated that the present disclosure encompasses any suitable apparatus, such as printers, digital copiers, bookmaking machines, facsimile machines, etc. which performs a print outputting function for any purpose.

A sheet size detection device 200 is shown in FIGS. 2-6. Device 200 is used in combination with MFD 100 to detect the size of sheets held in an adjustable sheet tray 300. Additionally, appropriate software may be used in connection with device 200. Sheet tray 300 includes a base 302, a first guide member 310 (e.g., a length guide member), a second guide member 320 (e.g., a pair of width guide members), a first bracket 330 (e.g., a length bracket), a second bracket 340 (e.g., a width bracket), and a plurality of switches 350.

The first guide member 310 is movable relative to the base 302 in the general direction of arrow A-A (see FIG. 2) in accordance with a first dimension (e.g., length) of the sheets held in the sheet tray 300. The second guide member 320 is movable relative to the base 302 in the general direction of arrow B-B (see FIG. 2) in accordance with a second dimension (e.g., width) of the sheets held in the sheet tray 300.

Figure 6:
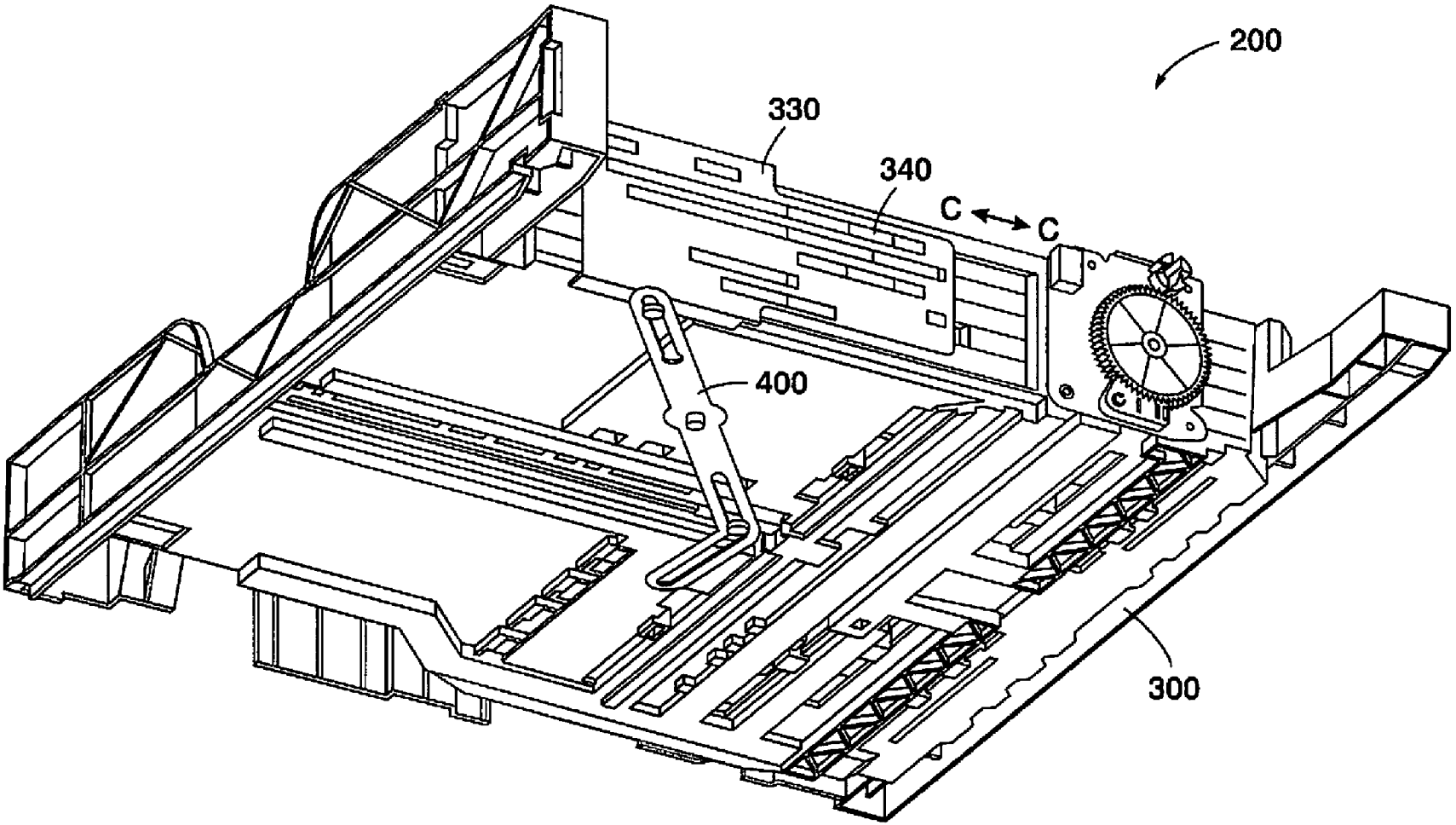
FIG. 6 is a bottom perspective view of the sheet tray of FIGS. 2-4 in accordance with embodiments of the present disclosure.

The first bracket 330 is operatively connected to the first guide member 310. By way of example, FIG. 6 illustrates a first link 400 operatively connecting the first bracket 330 and the first guide member 310. Here, when the first guide member 310 moves in the direction of arrow A-A, the first link 400 transfers this movement to the first bracket 330. Accordingly, as the first guide member 310 moves in the direction of arrow A-A, the first bracket 330 moves in the general direction of arrow C-C, which is generally parallel to arrow A-A.

Figure 4:
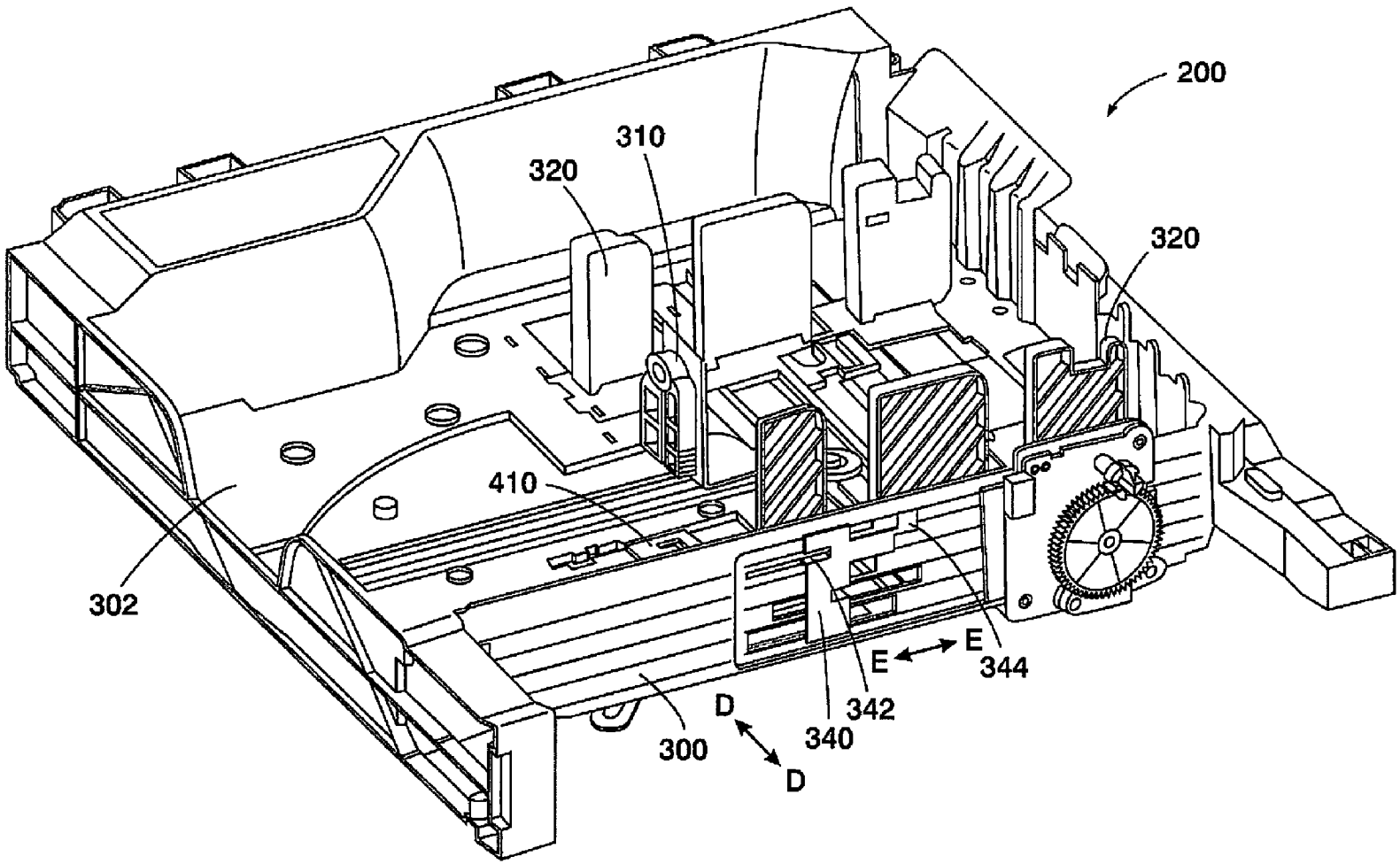
Figure 5:
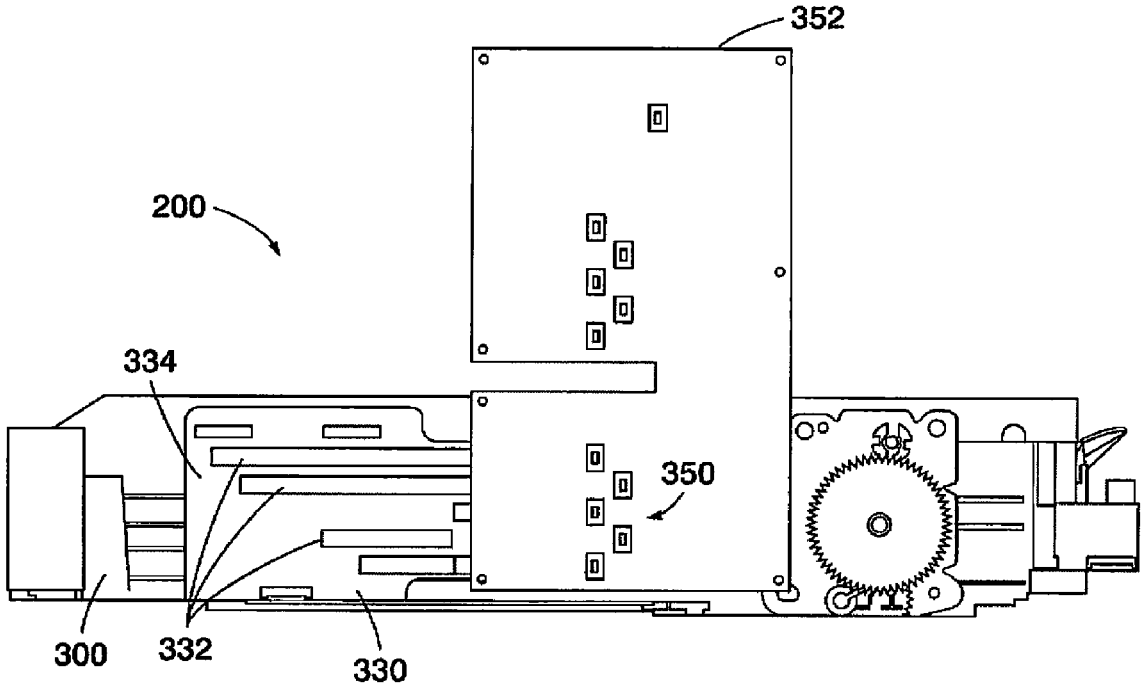
FIG. 5 is a rear end view of the sheet tray of FIGS. 2-4 in accordance with embodiments of the present disclosure.

The second bracket 340 is operatively connected to the second guide member 320. By way of example, FIG. 4 illustrates a second link 410 operatively connecting the second bracket 340 and the second guide member 320. Here, when the second guide member 320 moves in the direction of arrow D-D, the second link 410 transfers this movement to the second bracket 340. Accordingly, as the second guide member 320 moves in the direction of arrow D-D, the second bracket 340 moves in the general direction of arrow E-E, which is generally perpendicular to arrow D-D and generally parallel to arrow C-C.

Figure 2:
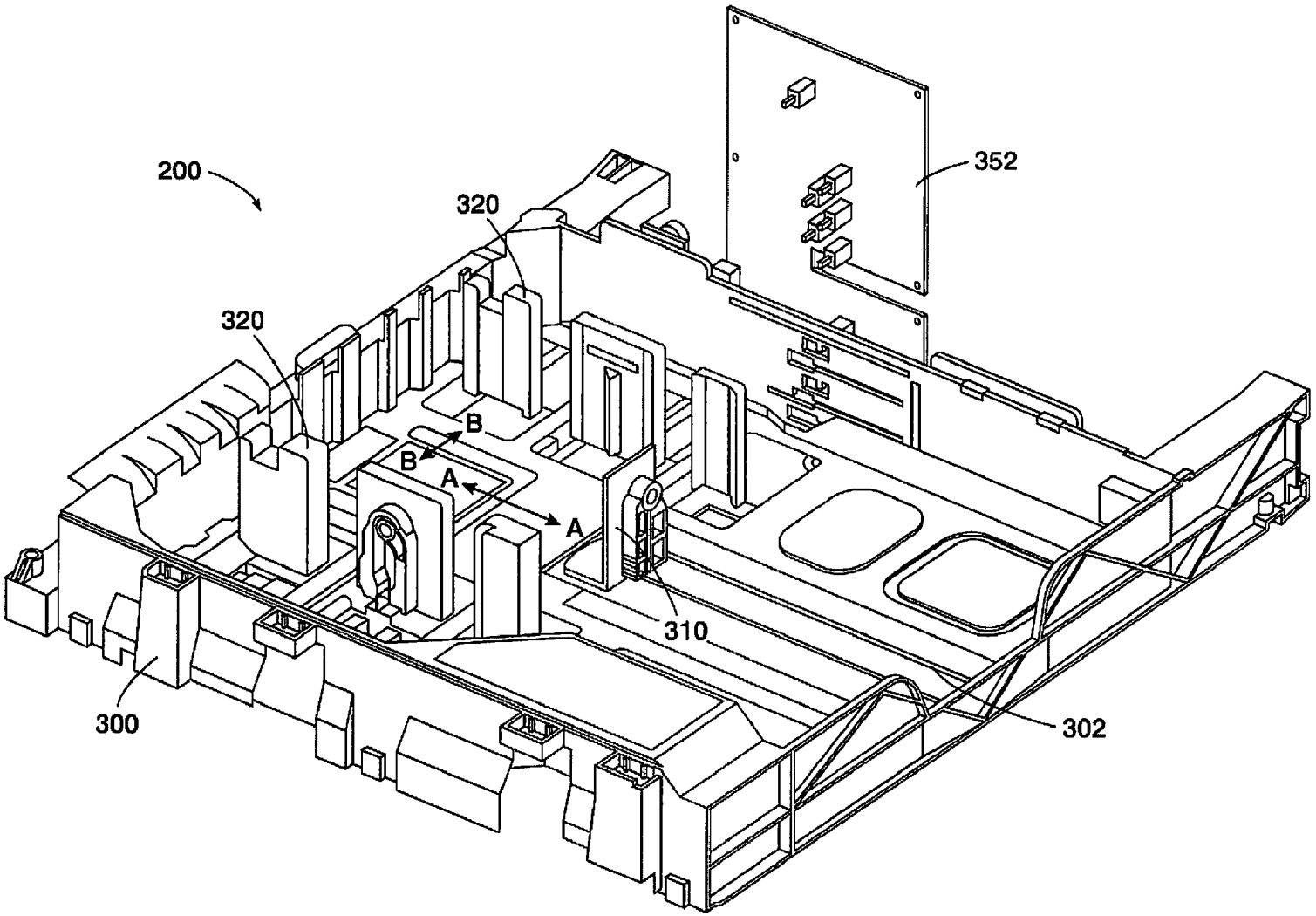
FIG. 2 perspective view of a sheet tray for use with the MFD of FIG. 1 in accordance with embodiments of the present disclosure.
Figure 3:
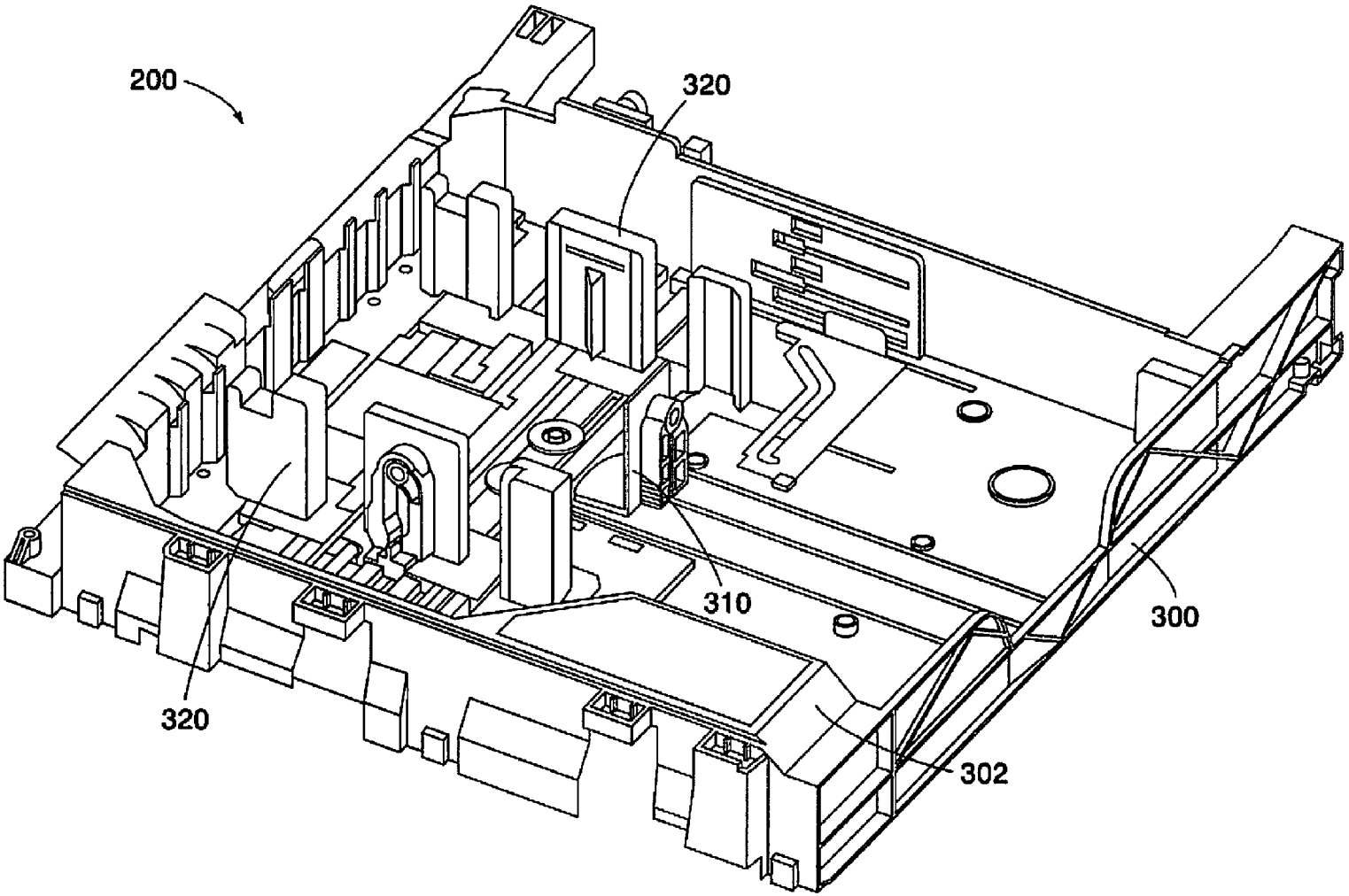
FIGS. 3 and 4 are perspective views of the sheet tray of FIG. 2 illustrated with various parts removed.

As shown in FIGS. 3-6, each of the first bracket 330 and the second bracket 340 includes a plurality of slots 332, 342, respectively, extending through a solid surface 334, 344, respectively, thereof. The plurality of switches 350 is shown on a printed circuit board (PCB) 352. In FIG. 2, two sets of switches are shown, each set of switches being configured for engagement by a single sheet tray 300 (one sheet tray 300 is shown). Each of the plurality of switches 350 is configured for selective engagement by at least one of the first bracket 340 and the second bracket 350. More specifically, the solid surface 334 and the plurality of slots 332 of the first bracket 330 are configured to interact with the solid surface 344 and the plurality of slots 342 of the second bracket 340 to selectively engage the plurality of switches 350. This selective engagement of the plurality of switches 350 enables conveyance (e.g., via a suitable signal) of two dimensions (i.e., length and width) of the sheet size.

More specifically, the first bracket 330 and the second bracket 340 are configured to slide adjacent each other (in the directions or arrow C-C and arrow E-E, respectively) with respect to the sheet tray 300. As can be appreciated, when the guide members 310, 320 are stationary (e.g., after they have been moved to accommodate a particular sheet size), the respective brackets 330, 340 are stationary, are juxtaposed with one another, and a portion of each of which is aligned with each of the plurality of switches 350. That is, depending on the positions of brackets 330, 340, and more particularly the slots 332, 342 in the respective brackets, each of the plurality of switches 350 is aligned with either a solid surface (i.e., either solid surface 334 of first bracket 330 and/or solid surface 344 of second bracket 340) or two slots (i.e., slot 332 and slot 342).

It is envisioned that when a solid surface 334 or 344 is aligned with a particular switch 350, the switch 350 is mechanically engaged (or otherwise activated, e.g., optically). For illustrative purposes, an activated switch 350 receives a value of "1"; a non-activated switch (i.e., when the switch 350 is aligned with slots 332 and 342) receives a value of "0." In the illustrated embodiments, the plurality of switches 350 includes five individual switches and each switch is capable of being in an activated position or a non-activated position. Thus, there are 32 (i.e., $2^5$) possible switch configurations.

In the illustrated embodiments, the slots 332, 342 of the respective brackets 330, 340 are each oriented in five rows. As can be appreciated, the position and dimensions of the slots 332, 342 determine the amount of the plurality of switches 350 that are activated based on the particular dimensions (i.e., length and width) of the sheets held in the sheet tray 300. That is, based on which of the plurality of switches 350 that have been activated, the sheet size detection device 200 is able to determine the range of lengths and the range of widths of the particular media held in the sheet tray 300.

In accordance with various embodiments of the present disclosure, the orientation of the slots 332 in the first bracket 330 and the slots 342 in the second bracket 340 is configured to correspond to at least seven ranges of possible lengths and at least three ranges of possible widths, which form at least 21 two-dimension ranges. An example of such ranges is shown in Chart 1, reproduced below. It is envisioned that the width and length ranges are configured such that only one size of standard media (including seven standard US media sizes and four standards European media sizes) corresponds to a single two-dimensional range. It is also envisioned that there is at least one pair of sizes that fail within the same two-dimensional range, such that at least 19 of the two-dimensional ranges correspond to only one size of standard media.

In such situations, (i.e., when a two-dimensional range is detected that can correspond to two different standard media sizes), it is envisioned that the user is prompted (e.g., via the UI 110) to select (e.g., from a list including the two different standard media sizes) the actual media that is held in the paper tray 300. In various embodiments, it is envisioned that the user is given the option to select a secondary media size, e.g., based on the two-dimensional range that is detected.

CHART 1

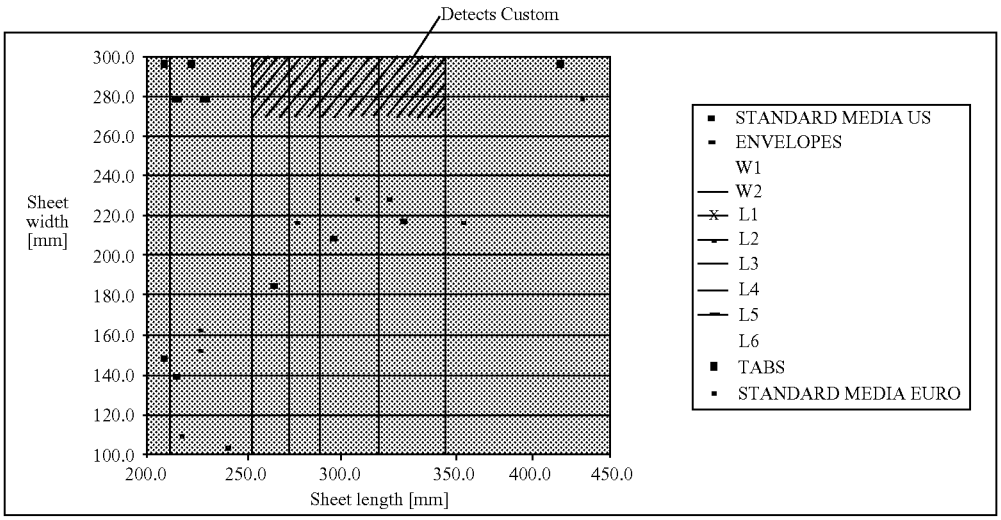

In the example shown in Chart 1, a majority of the transition lines (i.e., the lines that separate the length and width ranges) are at least 6 mm away from a standard media size. This positioning of the transition lines helps ensure robustness of the MFD 100. That is, the 6 mm range allows for the build up of mechanical tolerances.

When a custom-sized media (i.e., not a standard size) is held in the sheet tray 300, the sheet size detection device 200 is able to determine that the media is a custom size if the custom-sized media is within the dimensional ranges above (in the shaded area labeled "Detects Custom" in Chart 1). As shown, there are no standard-sized media within the "Detects Custom" ranges. It is further envisioned that when custom media is detected in the sheet tray 300, the information about the media (i.e., the length range and the width range) is transmitted to a user interface (UI) 110 (FIG. 1). The UI 110 may then prompt a user to confirm the media is custom and to input the length and width dimensions of the custom media. Since the UI 110 has received the information about the custom media, the UI 110 will be able to detect if the user incorrectly enters dimensions that are outside of the detected ranges. Thus, it is envisioned that the amount of errors related to incorrect user inputs will decrease. Moreover, if the custom-sized media is not within the "Detects Custom" ranges, it is envisioned that the user will be able to input the media size using the UI 110.

Additionally, in various embodiments, the UI 110 is configured to give the user the option of selecting a custom media size even when the sheet size detection device 200 detects media within one of the two-dimensional ranges that is associated with a standard size media.

The present disclosure also includes embodiments of the device 200 where consecutive ranges of possible lengths and/or widths share four common switch positions. An example of an embodiment where both the lengths and widths of consecutive ranges is shown in Chart 2 below. That is, only one switch position changes between adjacent length ranges and only one switch position changes between adjacent width ranges.

In such embodiments, when media sheets are held on sheet tray 300 and the device 200 detects that the first guide 310, for example, is at a position that corresponds to the first bracket 330 being at or near the boundary between two different lengths, the device 200 will detect a single range associated with each dimension. More specifically, for example, if the media held in the sheet tray 300 is 9.5"×8.5", the device 200 will detect that the width is in the "B" range and that the length is in either of length range "2" or "3." Moreover, the only difference is switch positions in these ranges is the position of the fifth switch. That is, in the embodiments illustrated in Chart 2, for media having a width in the "B" range (e.g., about 8.5") and a length in the "2" range (e.g., 8.5"), the switch positions is "0 0 0 1 1"; for media having a width in the "B" range (e.g., 8.5") and a length in the "3" range (e.g., 10.5"), the switch positions is "0 0 0 1 0." Therefore, if the device 200 detects the first four switch positions as "0 0 0 1," the media in the sheet tray 300 must be within the "B" width range and within either the "2" or "3" length range. With this information, the UI 110 will be able to prompt (or confirm) user-inputted information accordingly. That is, the single switch changes across the boundaries helps ensure that there is essentially no missed range detections at those boundaries.

In accordance with embodiments of the present disclosure, it is envisioned that the first two switch positions correspond to a media's width and the third three switch positions correspond to its length. It is further envisioned that activation of the first two switch positions signifies that an envelope is detected in sheet tray 300. An example of the assignment of switch positions and associated media sizes is illustrated in Chart 3, below. Here, when a combination of switches is not assigned to a particular size of media, it is noted as "FREE."

CHART 2

| LENGTH | | | | | | | | | | | |
|---|---|---|---|---|---|---|---|---|---|---|---|
| A5 & A4 LEF | 8.5" | 10.5" | 11" | A4 SEF | 13" | 14" | | | | | |
| 1 | 2 | 3 | 4 | 5 | 6 | 7 | | | | | |
| 0 0 0 0 1 | 0 0 0 1 1 | 0 0 0 1 0 | 0 0 1 1 0 | 0 0 1 0 0 | 0 0 1 0 1 | 0 0 1 1 1 | | | | | |
| A4 LEF | A4 LEF | 1 | 2 | 3 | 4 | A3 SEF | | | | | |
| 1 0 0 0 1 | 1 0 0 1 1 | 1 0 0 1 0 | 1 0 1 1 0 | 1 0 1 0 0 | 1 0 1 0 1 | 1 0 1 1 1 | 1 0 0 0 0 | A | A4 LEF & A3 | | |
| LTR LEF | LTR LEF | 5 | 6 | 7 | 8 | TABLOID | | | | | |
| 0 0 0 0 1 | 0 0 0 1 1 | 0 0 0 1 0 | 0 0 1 1 0 | 0 0 1 0 0 | 0 0 1 0 1 | 0 0 1 1 1 | 0 0 0 0 0 | B | 8.5" | | |
| A5 | STATEMENT | EXEC | LTR SEF | A4 SEF | FOLIO | LEGAL | | | | | |
| 0 1 0 0 1 | 0 1 0 1 1 | 0 1 0 1 0 | 0 1 1 1 0 | 0 1 1 0 0 | 0 1 1 0 1 | 0 1 1 1 1 | 0 1 0 0 0 | C | A5 | | |

WIDTH

| |
|---|
| 1 INDICATES THE SENSOR IS BLOCKED |
| 0 INDICATES THE SENSOR IS NOT BLOCKED |

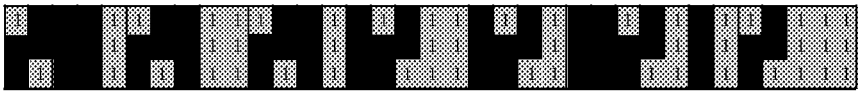

GREEN INDICATES THE SENSOR IS BLOCKED

CHART 3

| | Switch 1 | Switch 2 | Switch 3 | Switch 4 | Switch 5 | | WIDTH REGION | LENGTH REGION | Width Min | Width Max | Length Min | Length Max |
|---|---|---|---|---|---|---|---|---|---|---|---|---|
| 1 | 0 | 0 | 0 | 0 | 0 | TRAY OPEN | X | X | X | X | X | X |
| 2 | 0 | 0 | 1 | 0 | 0 | 7 | B | 5 | 263 | 294 | 282 | 320 |
| 3 | 0 | 0 | 0 | 1 | 0 | 5 | B | 3 | 263 | 294 | 248 | 279 |
| 4 | 0 | 0 | 0 | 0 | 1 | LTR LEF | B | 1 | 263 | 294 | 204 | 219 |
| 5 | 0 | 0 | 1 | 1 | 0 | 6 | B | 4 | 263 | 294 | 267 | 294 |
| 6 | 0 | 0 | 0 | 1 | 1 | LTR LEF | B | 2 | 263 | 294 | 207 | 260 |
| 7 | 0 | 0 | 1 | 0 | 1 | 8 | B | 6 | 263 | 294 | 308 | 349 |
| 8 | 0 | 0 | 1 | 1 | 1 | TABLOID | B | 7 | 263 | 294 | 337 | 432 |
| 9 | 1 | 0 | 0 | 0 | 0 | FREE | X | X | X | X | X | X |
| 10 | 1 | 0 | 1 | 0 | 0 | 3 | A | 5 | 282 | 304 | 282 | 320 |
| 11 | 1 | 0 | 0 | 1 | 0 | 1 | A | 3 | 282 | 304 | 248 | 279 |
| 12 | 1 | 0 | 0 | 0 | 1 | A4 LEF | A | 1 | 282 | 304 | 204 | 219 |
| 13 | 1 | 0 | 1 | 1 | 0 | 2 | A | 4 | 282 | 304 | 267 | 294 |
| 14 | 1 | 0 | 0 | 1 | 1 | A4 LEF | A | 2 | 282 | 304 | 207 | 260 |
| 15 | 1 | 0 | 1 | 0 | 1 | 4 | A | 6 | 282 | 304 | 308 | 349 |
| 16 | 1 | 0 | 1 | 1 | 1 | A3 SEF | A | 7 | 282 | 304 | 337 | 432 |
| 17 | 0 | 1 | 0 | 0 | 0 | FREE | X | X | X | X | X | X |
| 18 | 0 | 1 | 1 | 0 | 0 | A4 SEF | C | 5 | 136 | 277 | 282 | 320 |
| 19 | 0 | 1 | 0 | 1 | 0 | EXEC | C | 3 | 136 | 277 | 248 | 279 |
| 20 | 0 | 1 | 0 | 0 | 1 | A5 | C | 1 | 136 | 277 | 204 | 219 |
| 21 | 0 | 1 | 1 | 1 | 0 | LTR SEF | C | 4 | 136 | 277 | 267 | 284 |
| 22 | 0 | 1 | 0 | 1 | 1 | STATEMENT | C | 2 | 136 | 277 | 207 | 260 |
| 23 | 0 | 1 | 1 | 0 | 1 | FOLIO | C | 6 | 136 | 277 | 308 | 349 |
| 24 | 0 | 1 | 1 | 1 | 1 | LEGAL | C | 7 | 136 | 277 | 337 | 432 |
| 25 | 1 | 1 | 0 | 0 | 0 | FREE | X | X | X | X | X | X |
| 26 | 1 | 1 | 1 | 0 | 0 | FREE | X | X | X | X | X | X |
| 27 | 1 | 1 | 0 | 1 | 0 | FREE | X | X | X | X | X | X |
| 28 | 1 | 1 | 0 | 0 | 1 | FREE | X | X | X | X | X | X |
| 29 | 1 | 1 | 1 | 1 | 0 | FREE | X | X | X | X | X | X |
| 30 | 1 | 1 | 0 | 1 | 1 | FREE | X | X | X | X | X | X |
| 31 | 1 | 1 | 1 | 0 | 1 | FREE | X | X | X | X | X | X |
| 32 | 1 | 1 | 1 | 1 | 1 | FREE | X | X | X | X | X | X |

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A sheet size detection device for detecting a size of sheets which are held in a sheet tray, comprising:

a first guide member for defining a position of the sheets in a first direction of said sheets, the first guide member being movable in accordance with a first dimension of the sheets;

a second guide member for defining a position of the sheets in a second direction of the sheets, the second direction being orthogonal to the first direction, the second guide member being movable in accordance with a second dimension of the sheets;

a first bracket operatively connected to the first guide member, the first bracket having a substantially smooth outer surface and including a plurality of slots of non-uniform length extending therethrough in a parallel manner, wherein each of the plurality of slots has a length greater than a height associated therewith;

a second bracket operatively connected to the second guide member, the second bracket having a substantially smooth outer surface and slidably engaging the first bracket and including a plurality of slots of non-uniform length extending therethrough in a parallel manner, wherein each of the plurality of slots has a length greater than a height associated therewith; and a plurality of switches configured for selective engagement by at least one of the first bracket and the second bracket, wherein the solid surface and the plurality of slots of the first bracket, and the solid surface and the plurality of slots of the second bracket are configured to interact with one another to selectively engage the plurality of switches, and wherein the selective engagement of the plurality of switches enables conveyance of two dimensions of the sheet size.

2. The device of claim 1, wherein the slots of each of the first bracket and the second bracket are disposed in five rows.

3. The device of claim 1, wherein a switch is engaged when a portion of the solid surface of at least one of the first bracket and the second bracket is aligned therewith.

4. The device of claim 1, wherein the plurality of switches includes five switches which are positionable in a total of 32 switch positions.

5. The device of claim 4, wherein the first direction corresponds to the length of the sheets and the second direction corresponds to the width of the sheets.

6. The device of claim 5, wherein the orientation of the slots in the first bracket and the second bracket is configured to correspond to at least seven ranges of possible lengths and at least three ranges of possible widths, which form at least 21 two-dimension ranges.

7. The device of claim 6, wherein consecutive ranges of possible lengths share four common switch positions.

8. The device of claim 7, wherein consecutive ranges of possible widths share four common switch positions.

9. The device of claim 6, wherein the length and width ranges are configured such that at least 19 of the two-dimensional ranges correspond to only one size of standard media, the standard media including seven standard US media sizes and four standards European media sizes.

10. The device of claim 6, wherein the length and width ranges enable detection of a two-dimensional range of custom-sized media held in the sheet tray.

11. A sheet tray positionable in a printing device, the sheet tray comprising:

a base;

a length guide slidably disposed with relation to the base;

a width guide slidably disposed with relation to the base;

a first bracket disposed in mechanical cooperation with the length guide, the first bracket having a substantially smooth outer surface and including a plurality of slots of non-uniform length extending therethrough in a parallel manner, wherein each of the plurality of slots has a length greater than a height associated therewith;

a second bracket disposed in mechanical cooperation with the width guide, the second bracket having a substantially smooth outer surface and including a plurality of slots of non-uniform length extending therethrough in a parallel manner, wherein each of the plurality of slots has a length greater than a height associated therewith; and a plurality of switches disposed in mechanical cooperation with the first bracket and with the second bracket;

wherein the solid surface and the plurality of slots of the first bracket, and the solid surface and the plurality of slots of the second bracket are configured to interact with one another to selectively engage the plurality of switches, and wherein the selective engagement of the plurality of switches enables conveyance of two dimensions of the sheet size.

12. The sheet tray of claim 11, wherein the orientation of the slots in the first bracket and the second bracket is configured to correspond to at least seven ranges of possible lengths and at least three ranges of possible widths, which form at least 21 two-dimension ranges.

13. The sheet tray of claim 12, wherein consecutive ranges of possible lengths share four common switch positions.

14. The sheet tray of claim 13, wherein consecutive ranges of possible widths share four common switch positions.

15. The sheet tray of claim 12, wherein the length and width ranges are configured such that at least 19 of the two-dimensional ranges correspond to only one size of standard media, the standard media including seven standard US media sizes and four standards European media sizes.

16. The sheet tray of claim 12, wherein the length and width ranges enable detection of a two-dimensional range of custom-sized media held in the sheet tray.

17. A multi-functional device comprising a sheet size detection device, the printing device comprising:

a sheet tray positionable in the printing device, the sheet tray comprising:

a base;

a length guide slidably disposed with relation to the base;

a width guide slidably disposed with relation to the base;

a first bracket disposed in mechanical cooperation with the length guide, the first bracket having a substantially smooth outer surface and including a plurality of slots of non-uniform length extending therethrough in a parallel manner, wherein each of the plurality of slots has a length greater than a height associated therewith;

a second bracket disposed in mechanical cooperation with the width guide, the second bracket having a substantially smooth outer surface and including a plurality of slots of non-uniform length extending therethrough in a parallel manner, wherein each of the plurality of slots has a length greater than a height associated therewith; and a plurality of switches disposed in mechanical cooperation with the first bracket and with the second bracket;

wherein the solid surface and the plurality of slots of the first bracket, and the solid surface and the plurality of slots of the second bracket are configured to interact with one another to selectively engage the plurality of switches, and wherein the selective engagement of the plurality of switches enables conveyance of two dimensions of the sheet size.

18. The multi-functional device of claim 17, further comprising a user interface configured to receive information from the plurality of switches.

19. The multi-functional device of claim 17, wherein the orientation of the slots in the first bracket and the second bracket is configured to correspond to at least seven ranges of possible lengths and at least three ranges of possible widths, which form at least 21 two-dimension ranges, wherein consecutive ranges of possible lengths share four common switch positions, and wherein consecutive ranges of possible widths share four common switch positions.

20. The multi-functional device of claim 19, wherein the length and width ranges are configured such that at least 19 of the two-dimensional ranges correspond to only one size of standard media, the standard media including seven standard US media sizes and four standards European media sizes.

* * * * *